US011866862B2

(12) United States Patent
Graham et al.

(10) Patent No.: US 11,866,862 B2
(45) Date of Patent: Jan. 9, 2024

(54) KNITTED FABRIC

(71) Applicant: GALE PACIFIC LIMITED, Braeside (AU)

(72) Inventors: Garth Graham, Braeside (AU); Shane Graham, Braeside (AU); Andrew Nasarczyk, Braeside (AU)

(73) Assignee: GALE PACIFIC LIMITED, Braeside (AU)

( * ) Notice: Subject to any disclaimer, the term of this patent is extended or adjusted under 35 U.S.C. 154(b) by 599 days.

(21) Appl. No.: 16/763,633

(22) PCT Filed: Oct. 17, 2018

(86) PCT No.: PCT/AU2018/051126
§ 371 (c)(1),
(2) Date: May 13, 2020

(87) PCT Pub. No.: WO2019/095003
PCT Pub. Date: May 23, 2019

(65) Prior Publication Data

US 2020/0362490 A1 Nov. 19, 2020

(30) Foreign Application Priority Data

Nov. 14, 2017 (AU) ..... 2017904597

(51) Int. Cl.
*D04B 21/16* (2006.01)
*D04B 21/20* (2006.01)

(52) U.S. Cl.
CPC ..... *D04B 21/16* (2013.01); *D04B 21/202* (2013.01)

(58) Field of Classification Search
CPC ..... D04B 21/02; D04B 21/04; D04B 21/16; D04B 21/06; D04B 21/08; D04B 21/202
See application file for complete search history.

(56) References Cited

U.S. PATENT DOCUMENTS 4,399,671 A * 8/1983 Henningsson ..... A01G 9/1438 66/196
4,626,465 A * 12/1986 Henningsson ..... D03D 15/46 442/305

(Continued)

FOREIGN PATENT DOCUMENTS

EP 1369515 A1 12/2003
EP 1586684 A1 10/2005

(Continued)

OTHER PUBLICATIONS

International Preliminary Report on Patentability for International Application No. PCT/AU2018/051126 filed Oct. 17, 2018; dated Dec. 19, 2019; 20 pages.

(Continued)

*Primary Examiner* — Danny Worrell
(74) *Attorney, Agent, or Firm* — CANTOR COLBURN LLP

(57) ABSTRACT

A knitted fabric, including: a front face and a rear face, wherein the front face includes a first plurality of fibres of at least one of a first colour, a first colour combination, a first material and a first material combination, and the rear face includes a second plurality of fibres of at least one of a second colour, a second colour combination, a second material and a second material combination, the fabric having a knit pattern wherein the first plurality of fibres are at least partially separated from the second plurality of fibres, such that the front face is visually different when compared to the rear face.

19 Claims, 3 Drawing Sheets

(56) References Cited

U.S. PATENT DOCUMENTS

| | | | | |
|---|---|---|---|---|
| 6,100,208 | A | 8/2000 | Brown et al. | |
| 6,105,401 | A * | 8/2000 | Chadeyron | D04B 1/22 66/196 |
| 6,199,410 | B1 * | 3/2001 | Rock | D04B 23/22 442/304 |
| 7,240,522 | B2 * | 7/2007 | Kondou | D04B 21/18 66/195 |
| 7,415,845 | B1 * | 8/2008 | Graichen | D04B 21/06 66/170 |
| 8,056,373 | B2 * | 11/2011 | Kazuma | E06B 9/266 66/196 |
| 10,968,549 | B1 * | 4/2021 | Li | D04B 27/24 |
| 2010/0175430 | A1 | 7/2010 | Garcia et al. | |
| 2012/0088085 | A1 * | 4/2012 | Kruse | D04B 1/18 5/490 |
| 2020/0080370 | A1 * | 3/2020 | Rahn | D04C 1/08 |

FOREIGN PATENT DOCUMENTS

| | | | |
|---|---|---|---|
| JP | 2003293250 | A1 | 10/2003 |
| WO | 2004108410 | A3 | 12/2004 |
| WO | 2017106906 | A1 | 6/2017 |

OTHER PUBLICATIONS

International Search Report and Written Opinion for International Application No. PCT/AU2018/051126 filed Oct. 17, 2018; dated Dec. 4, 2018; 9 pages.

* cited by examiner

KNITTED FABRIC

CROSS REFERENCE TO RELATED APPLICATIONS

This application is a National Stage application of PCT/AU2018/051126, filed Oct. 17, 2018, which claims the benefit of Australian Application No. 2017904597, filed Nov. 14, 2017, the contents of which are incorporated by reference in their entirety herein.

TECHNICAL FIELD

The present invention relates to a warp knitted fabric. The fabric has been specifically designed for use as solar shade and/or hail and/or wind protection cloth and will herein be generally described in this context. The fabric may be utilised in temporary, semi-permanent or permanent structure applications.

It is to be appreciated that the fabric may be utilised in other applications besides those referred to above. For example, the fabric may be used as a geotextile, building façade, privacy screen, advertising banner or screen, and for recreational applications such as camping, shooting and the like.

BACKGROUND

Existing knitted fabrics, particularly those designed for use as shade cloth, are most commonly manufactured on warp knitting machines, utilising patterns based on warp knitting technology.

Such fabrics are typically manufactured from monofilament of high-density polyethylene (HDPE), split film high-density polyethylene yarns (or fibres) or polypropylene.

Conventional shade cloths generally perform effectively in terms of being relatively durable, hard-wearing fabrics that provide desired levels of shade. However, these shade cloth fabrics provide what the applicant considers to be a potential limitation in terms of having both faces/sides of a similar or identical appearance. The applicant considers that opportunities exist for providing an architecturally more interesting, more aesthetically pleasing, and better performing shade cloth.

For example, the applicant considers that fabric performance may be improved (for at least some applications) by providing a shade cloth with a darker coloured face and a lighter coloured face. A darker coloured lower face may provide improved shading effect for anyone located beneath the shade cloth; while a lighter coloured upper face would reflect sunlight, hence providing a more comfortable for people, animals or vehicles located beneath the shade cloth.

The applicant recognises that there exists fabric having different colours and/or patterns on either side. For example, the applicant is aware of woven and non-woven coated fabrics, wherein one or both sides of the fabric are coated with different colours and/or additives. However, such coatings remove the inherent breathability of the knitted fabric. It also detracts from key mechanical attributes of a knitted fabric. Hence, a coating solution is considered by the applicant to be inappropriate for knitted fabric such as shade cloth.

It would therefore be desirable to provide a knitted fabric potentially suitable for a variety of application, including solar shade, hail and wind protection, that addresses the above shortcomings, and which has an enhanced aesthetic appearance when compared to existing fabrics.

SUMMARY OF THE INVENTION

According to one aspect of the present invention, there is provided a knitted fabric for use as a solar shade and/or hail and/or wind protection cloth, including a (technical) front face and a (technical) rear face (or back), wherein the front face includes a first plurality of fibres of at least one of a first colour, a first colour combination and a first material or material combination, and the rear face includes a second plurality of fibres of at least one of a second colour, a second colour combination and a second material or material combination. The fabric has a knit pattern wherein that the first plurality of fibres are at least partially separated from the second plurality of fibres, such that the front face is visually different when compared to the rear face.

Such an arrangement is desirable because it can provide a fabric that has faces with differing visual appearances. This may provide an architecturally more interesting fabric compared to one having the same or similar appearances on both faces. In terms of shade cloth fabric, there can be a conflict between providing an aesthetically pleasing product and a product that provides a suitable performance, especially over time. For example, the combination of a lighter coloured top face and a darker coloured bottom face work well, as lighter coloured shade cloths tend to plurality of fibres of second (grey) colour. The fabric 210 has a knit pattern wherein the first plurality of fibres are at least partially separated from the second plurality of fibres, such that the front face 212 is visually different when compared to the rear surface 214—this is clearly evident in FIG. 3. This provides an architecturally more interesting fabric 210 compared to a conventional fabric having the same or similar appearance on both surfaces.

Some structures incorporating the inventive fabric desirably have a distinctly varying appearance, depending on the angle from which the structure is viewed. In some such structures, the front face (perhaps in the form of a top face) may initially be most prominent and therefore noticed and, as an individual then moves around the structure, more of a mix of colours is noticed, until the individual is located beneath the structure and sees only the rear face (perhaps in the form of a bottom face) colour. Such an arrangement may add more visual interest than a shade cloth manufactured conventionally from a single colour, a single colour combination and/or single material.

Shade cloth fabrics having a lighter coloured upper face and darker coloured lower face will also generally perform better in terms of thermal comfort under the shade cloth. The principal for this difference in performance is fundamentally the same when comparing the performance of houses with lighter coloured roofs to houses with darker roofs which absorb a lot of solar radiation. The lighter top colour reflects a substantial amount of the solar energy, while the darker lower colour stops most of the light that has not been reflected by the top surface from penetrating down through the fabric to any individuals beneath the structure. In this way, a more dense shade is provided than can be provided by a lighter colour (which means less solar heat gain), while also not building up as much heat within the dark shade cloth fibres and re-radiating this heat as would occur with a shade cloth manufactured entirely of dark fibres. As a result, it should be cooler under a shade cloth manufactured according to the present invention when compared to a conventional shade cloth manufactured from a single colour. This principal will apply to most combinations of lighter coloured top faces and darker coloured bottom faces. Generally, the lighter the top face combined with as dark as possible a bottom face the better the thermal performance of the fabric.

Thus, in one preferred embodiment, the first plurality of fibres are at least predominantly a lighter colour when compared to the second plurality of fibres. More preferably, the first plurality of fibres are predominantly a light colour, and the second plurality of fibres are predominantly a dark colour.

In a preferred embodiment, the first plurality of fibres and second plurality of fibres are manufactured from Polyethylene. However, other materials are also proposed, in this regard at least one of the first plurality of fibres and the second plurality of fibres are at least substantially manufactured from at least one of nylon, polypropylene, polyester, ultra-high molecular weight high density polyethylene (UHMWHDPE), high-density polyethylene (HDPE), polytetrafluoroethylene (PTFE), carbon fibre, fibreglass and metal.

The fabric is preferably a warp knitted fabric.

In preferred embodiments, the thickness of each of the fibres of the first plurality of fibres and second plurality of fibres is between approximately 300 and 1,000 denier and, more preferably, approximately 477 denier. That said, the thickness of the first plurality of fibres may differ from the second plurality of fibres.

Preferably, each of the first and second plurality of fibres is manufactured from at least one of a monofilament, multifilament and tape.

It is envisaged that the fabric may be manufactured on a compound or latch needle warp knitting machine. In one form, four guide bars of the compound or latch needle warp knitting machine may be utilised to manufacture the fabric.

In such an arrangement, the four guide bars may include a front (or first) guide bar, a second guide bar, a third guide bar and a fourth guide bar that follow the following knitting movements to manufacture the fabric:

front guide bar: 1-0/0-1//;
second guide bar: 1-0/3-4//;
third guide bar: 0-0/3-3//; and
fourth guide bar: 3-3/0-0//.

In another arrangement, the four guide bars may include a front guide bar, a second guide bar, a third guide bar and a fourth guide bar that follow the following knitting movements to manufacture the fabric:

front guide bar: 1-0/0-1//;
second guide bar: 1-0/3-4//;
third guide bar: 0-0/1-1//; and
fourth guide bar: 4-4/0-0//.

It is to be appreciated that other knitting patterns and additional guide bars are also possible. In one form, an intertwining yarn may be provided at an angle to the warp or vertical direction.

In use, the front guide bar may supply yarn for a chain of knitted loops, the second guide bar may supply weft yarn, the third guide bar may supply an intertwined yarn, and the fourth guide bar may supply a laid-in yarn. In another form, each of the third and fourth guide bars may supply a laid-in yarn.

In one form, each of the front guide bar, second guide bar and third guide bar supplies monofilament yarn, and the fourth guide bar supplies tape yarn.

In at least some preferred embodiments, the fabric weight is in the order of 350 gsm+/−20 gsm, and the cover factor of the fabric is in the order of 95%+/−3%.

It is envisaged that the inventive fabric would be provided in the form of, or used as, one or more of a solar shade, hail and wind cloth protection fabric. That said, the fabric may also be utilised as any one or more of a geotextile, a building façade, a privacy screen, an advertising banner or a screen.

BRIEF DESCRIPTION OF THE DRAWINGS

It will be convenient to hereinafter describe preferred embodiments of the invention with reference to the accompanying figures. The particularity of the figures is to be understood as not limiting the preceding broad description of the invention.

DETAILED DESCRIPTION OF THE FIGURES

Figure 1:
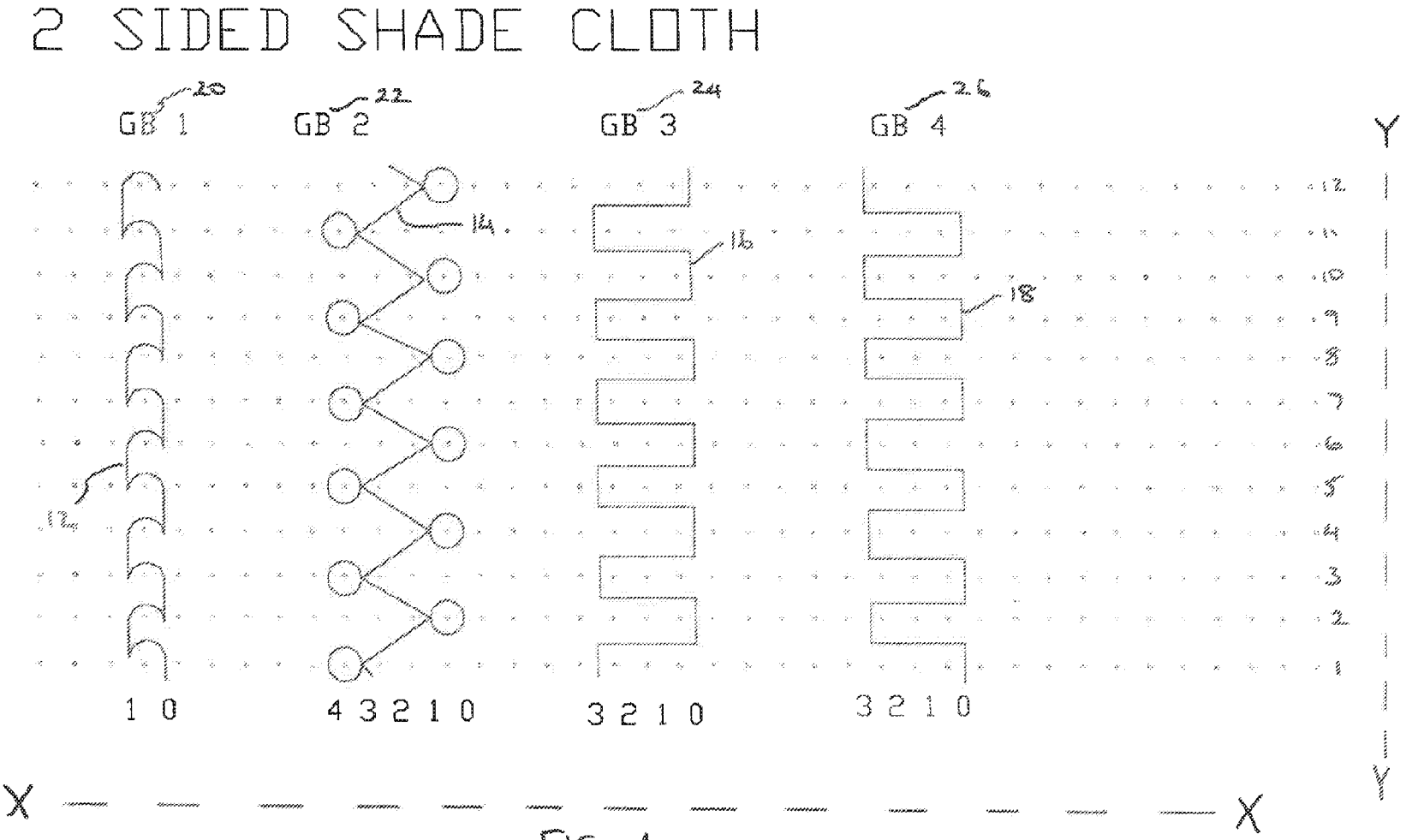
FIG. 1 is a schematic view of a knitted fabric according to one embodiment of the present invention. The matrix of dots represents knitted loops, vertical rows in the warp or machine direction, and the horizontal rows in the weft or lateral direction. The fabric components have been separated out and are shown in a side-by-side arrangement for clarity. In practice, loops would be formed in each column and row.

Referring to FIG. 1, there is depicted a knitted fabric 10 suitable for use as shade cloth (and/or wind protection cloth and/or hail protection cloth). As stated previously, the fabric components have been separated out and are shown in a side-by-side arrangement for clarity.

The fabric 10 includes a plurality of parallel chains 12 of knitted loops, with only one chain 12 being shown. The chains 12 are arranged parallel to one another and extend in the warp direction Y-Y. In the illustrated embodiment, each chain 12 is manufactured from a respective monofilament yarn of high-density polyethylene, although other suitable yarns may be used instead.

The fabric 10 also includes a plurality of weft yarns 14, although only one such weft yarn is shown. Each of the weft yarns 14 is manufactured from a respective monofilament yarn of high-density polyethylene, although other suitable yarns may be used instead. Each weft yarn 14 extends in the weft direction X-X, and extends about or through at least two adjacent chains 12 of knitted loops. Indeed, the fabric 10 may be designed such that each weft yarn 14 extends about or through any practical number of adjacent chains 12.

Each chain 12 of knitted loops is associated with a pair of yarns 16, 18, both of which exceed one chaining stitch, thereby producing a lay-in pattern—also called a knitting pattern. This has been shown by the applicant to provide a fabric having great coverage.

Like each chain 12 and weft yarn 14, yarn 16 of the illustrated embodiment is manufactured from a respective monofilament yarn of high density polyethylene, although other suitable yarns may be used instead. Yarn 18 is a tape yarn of high density polyethylene, although other suitable yarns may instead be used.

The fabric 10 is manufactured on a latch needle warp knitting machine, with four guide bars of the knitting machine being utilised to manufacture the fabric, and each introducing a yarn into the fabric structure. In such an arrangement, the four guide bars may include a front (or first) guide bar 20, a second guide bar 22, a third guide bar 24 and a fourth guide bar 26 that follow the following knitting movements to manufacture the fabric 10:

front guide bar: 1-0/0-1//;
second guide bar: 1-0/3-4//;
third guide bar: 0-0/3-3//; and
fourth guide bar: 3-3/0-0//

In use, the front guide bar 20 supplies the yarn for the chain 12 of knitted loops, the second guide bar 22 supplies the weft yarn 14, and the third and fourth guide bars 24, 26 supply the first and second laid-in yarns 16, 18, respectively. The front guide bar 20 carries yarn of chains 12 around the needle hooks (overlap) to produce vertical rows of loops in a configuration known as open loop pillar stitch. On the successive course, they traverse around the needle hooks in the opposite direction. There is no underlap movement.

The second guide bar 22 carries the weft yarn 14 around the needle hooks (overlap) and then across the back of the needles for several needle spaces during the underlap part of the knitting cycle. It is to be appreciated that the size of these underlaps may be varied to manipulate the weight of the fabric 10 and its horizontal stability. The second guide bar 22 enters and exits between the needles during the overlap part of the knitting cycle, thus being joined to the knitted loops as "lay-in" yarns.

The third guide bars 24, 26 carry yarns 16, 18, respectively, making a lay-in pattern.

The interaction of the four yarn components 12, 14, 16, 18 is integral to the success of this invention, in part, by providing a fabric with great coverage.

The denier of the fibres in yarns 12, 14, 16, 18 may be selected as desired. As stated previously, the applicant envisages a thickness somewhere between approximately 300 and 1,000 denier, with a thickness of approximately 477 denier currently envisaged by the applicant as being suitable for use in the fabric 10.

The applicant has established during trials that an aesthetically pleasing and functional fabric 10 is provided. The fabric 10 is considered by the applicant to be unique to their invention, at least in the context of solar shade cloth (as well as hail and/or wind protection cloth). Moreover, it clearly distinguishes the applicant's fabric 10 from their competitors' products because of the differing aesthetic appearance (and potentially differing performances characteristics) of the sides of the fabric 10.

Figure 2:
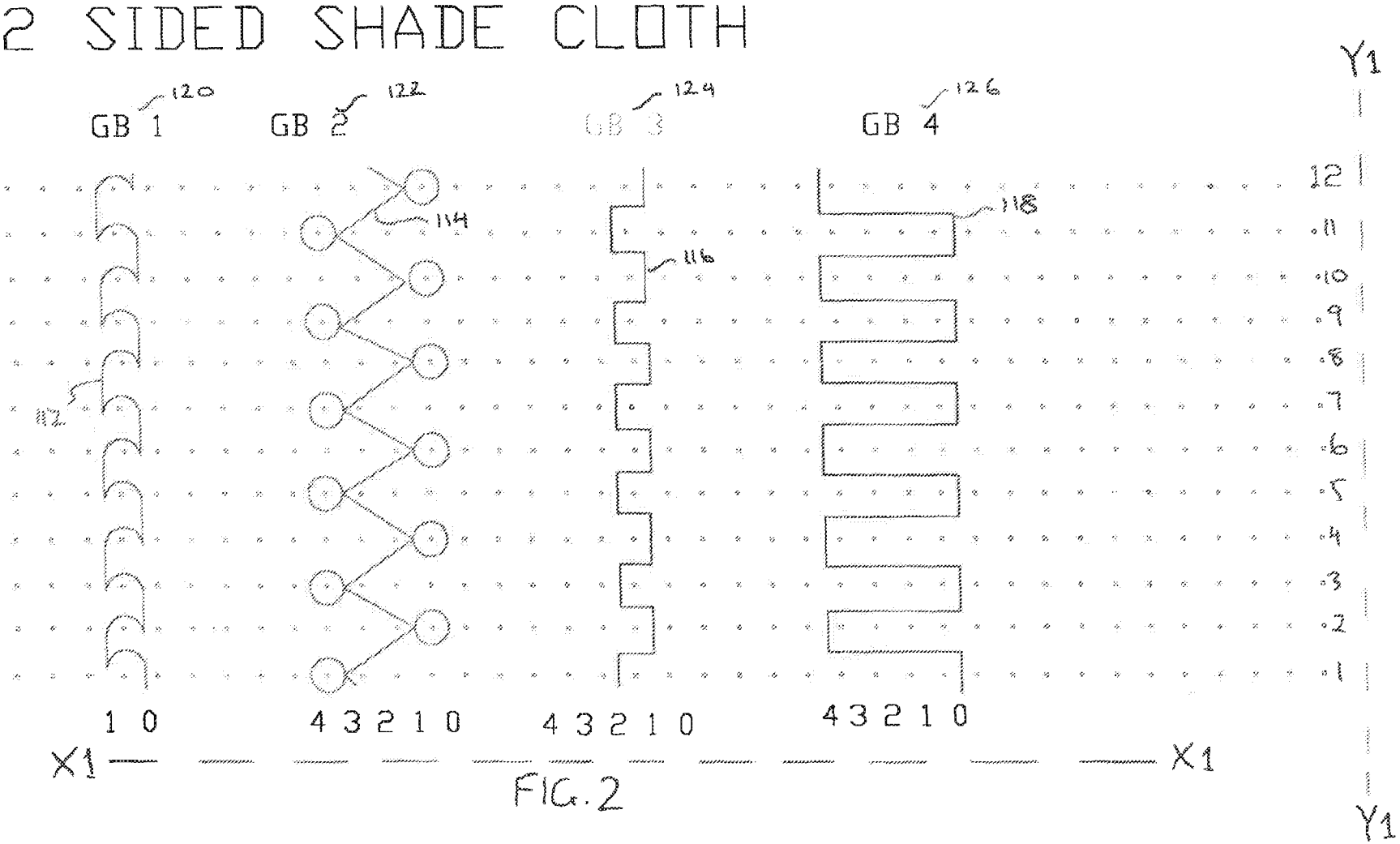
FIG. 2 is a schematic view of a knitted fabric according to another embodiment of the present invention. The matrix of dots represents knitted loops, vertical rows in the warp or machine direction, and the horizontal rows in the weft or lateral direction. The fabric components have been separated out and are shown in a side-by-side arrangement for clarity. In practice, loops would be formed in each column and row.

Referring to FIG. 2, there is depicted another of the applicant's knitted fabrics 110 suitable for use as shade cloth (and/or wind protection and/or hail protection cloth). Again, the fabric components have been separated out and are shown in a side-by-side arrangement for clarity.

The fabric 110 includes a plurality of parallel chains 112 of knitted loops, with only one chain 112 being shown. The chains 112 are arranged parallel to one another and extend in the warp direction Y1-Y1. In the illustrated embodiment, each chain 112 is manufactured from a respective monofilament yarn of high-density polyethylene, although other suitable yarns may be used instead.

The fabric 110 also includes a plurality of weft yarns 114, although only one such weft yarn is shown. Each of the weft yarns 114 is manufactured from a respective monofilament yarn of high-density polyethylene, although other suitable yarns may be used instead. Each weft yarn 114 extends in the weft direction X1-X1, and extends about or through at least two adjacent chains 112 of knitted loops. Indeed, the fabric 110 may be designed such that each weft yarn 114 extends about or through any practical number of adjacent chains 112.

Each chain 112 of knitted loops is associated with a yarn 116. Each yarn 116 is connected to and intertwines along the chain 112 of knitted loops. It can be seen that the yarn 116 extends around each successive knitted loop, providing restriction to the stretching of the loops of the chain 112 when under tension, as well as contributing load bearing capacity to the fabric 110 in the warp direction Y1-Y1. The provision of yarns about pillar stitch columns (such as those of chains 112) is an element that the applicant is aware of having been used in net constructions, including laces. However, in those constructions, connection of the yarns to the pillar stitch occurs at each course, with the intention of "hiding" the yarn until moved several needle spaces during the underlap phase of a knitting cycle to produce horizontal yarn elements to yield the net structure. Relatively little mechanical benefit is obtained from these yarns in the vertical (or warp) direction. The applicant's co-pending international patent application PCT/AU2016/051166 (WO2017/106906) details similar benefits to that provided by intertwined yarn 116, and so the disclosure of this co-pending application is to be incorporated herein by reference.

As noted in application PCT/AU2016/051166 (WO2017/106906), the applicant is also aware of previous attempts at running reinforcing yarns down chain stitches so as to act as a tear resistant component. In such arrangements, the reinforcing yarns lap around the needle loop at each course, and, unlike the present invention shown in FIG. 2, little if any dimensional stability increase is obtained. Like each chain 112 and weft yarn 114, each intertwining yarn 116 of the illustrated embodiment in FIG. 2 is manufactured from a respective monofilament yarn of high density polyethylene, although other suitable yarns may be used instead.

Yarn 118 is provided in a lay-in, or knitting pattern, and is in the form of tape yarn, although other suitable yarns may be used instead.

The fabric 110 is manufactured on a latch needle warp knitting machine, with four guide bars of the knitting machine being utilised to manufacture the fabric, and each introducing a yarn into the fabric structure. In such an arrangement, the four guide bars may include a front (or first) guide bar 120, a second guide bar 122, a third guide bar 124 and a fourth guide bar 126 that follow the following knitting movements to manufacture the fabric 110:

front guide bar: 1-0/0-1//;
second guide bar: 1-0/3-4//;
third guide bar: 0-0/1-1//; and
fourth guide bar: 4-4/0-0//

In use, the front guide bar 120 supplies the yarn for the chain 112 of knitted loops, the second guide bar 122 supplies the weft yarn 114, the third guide bar 124 supplies the first intertwined yarn 116, and the fourth guide bar 124 supplies the lay-in yarn 118. The front guide bar 120 carries the yarn of chains 112 around the needle hooks (overlap) to produce vertical rows of loops in a configuration known as open loop pillar stitch. On the successive course, they traverse around the needle hooks in the opposite direction. There is no underlap movement. The second guide bar 122 carries the weft yarn 114 around the needle hooks (overlap) and then across the back of the needles for several needle spaces during the underlap part of the knitting cycle. It is to be appreciated that the size of these underlaps may be varied to manipulate the weight of the fabric 110 and its horizontal stability.

The second guide bar 122 enters and exits between the needles during the overlap part of the knitting cycle, thus being joined to the knitted loops as "lay-in" yarns. The third guide bar 124 carries yarn 116 making no underlap movement for one or more knitting cycles as well as no overlaps, and then moves one needle space of underlap before repeating the miss-lap cycle and returning to its original position. The yarn 118 introduced by the third guide bars 124 provides an enclosure around each knitted loop, providing restriction to the stretching of the loops under tension as well as contributing fabric load bearing capacity in its own right. Careful balancing of the run-ins of the guide bars 120, 122, 124, 126 optimizes the load bearing capacity of the fabric 110 in both vertical (warp) and horizontal (weft) directions. The applicant considers that this clearly distinguishes the applicant's fabric 110 from their competitors' products that lack warp direction strength, and that lack the aesthetic distinctiveness of the fabric 120.

The fourth guide bar 126 provides lay-in yarn 118.

It can be appreciated that the third guide bar 124 supplies yarns 116 to enclose the knitted loops, restricting their ability to deform under load, and provide additional load carrying capacity and stretch resistance. It is envisaged that the yarns 116 may, instead, be replaced by yarns from two guide bars.

The interaction of the above described yarn components is integral to the success of this invention, and provides a shade cloth fabric 110 that the applicant considers is unique.

The denier of the fibres of yarns 112, 114, 116 and 118 may be selected as desired. The applicant envisages a thickness somewhere between approximately 300 and 1,000 denier, with a thickness of approximately 477 denier currently envisaged by the applicant as being suitable for use in fabric 110.

Figure 3:
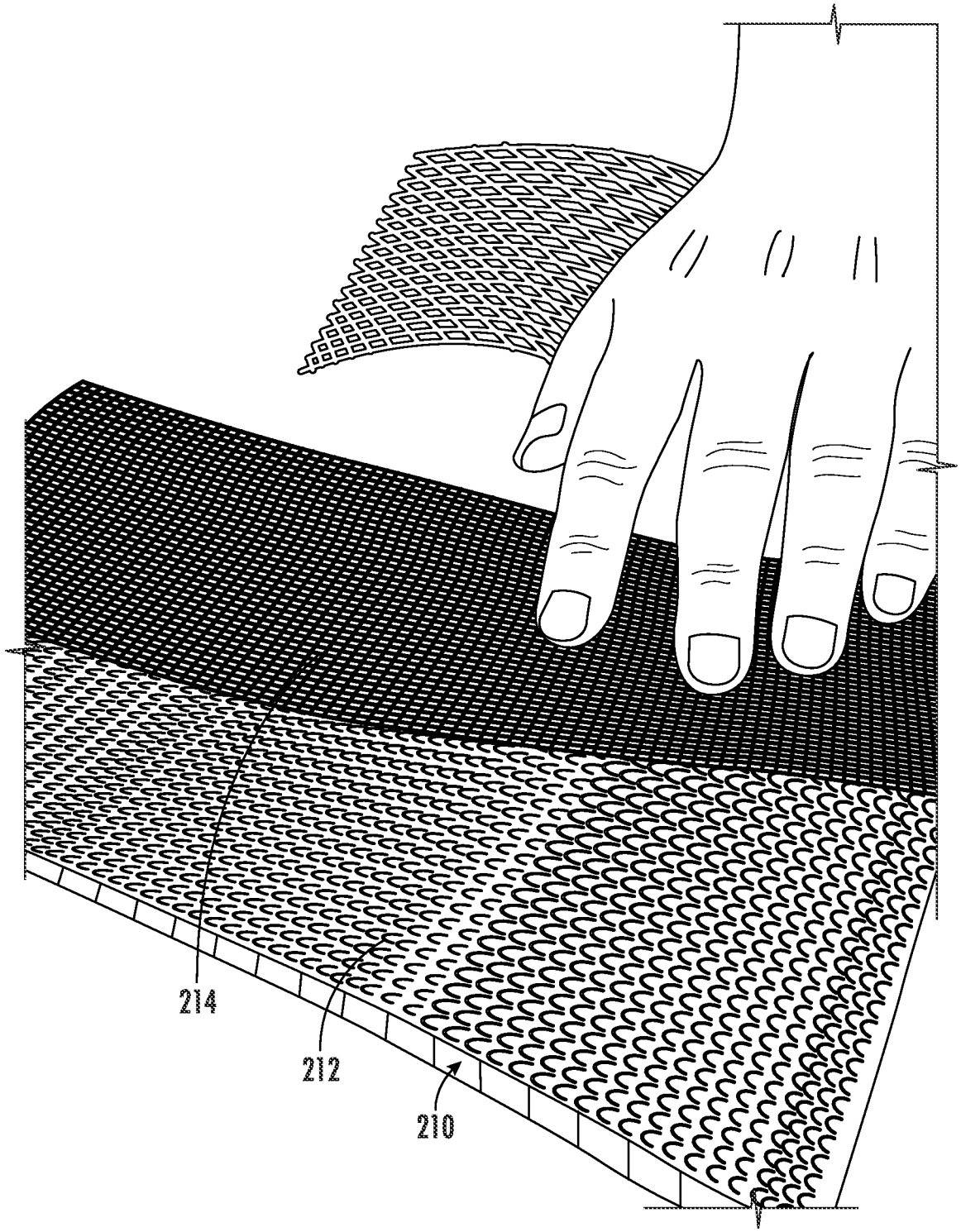
FIG. 3 is a photograph of a perspective view of a knitted fabric according to one embodiment of the present invention. The fabric is shown doubled over, such that the front face and rear face are both visible. The model's hand shown in FIG. 3 does not form part of the invention.

Referring to the FIG. 3, there is shown a photograph of a knitted shade cloth fabric corresponding to the schematic of either of the embodiments shown in FIGS. 1 and 2. For the present description, the fabric of FIG. 3 will be identified by reference "210", although it is to be appreciated that it may correspond to either of fabrics 10 and 110 shown in FIGS. 1 and 2.

It can be seen that the fabric 210 includes a (technical) front face 212 and a (technical) rear face (or back) 214, wherein the front face 212 includes a first plurality of fibres of a first (beige) colour, and the rear face 214 includes a second plurality of fibres of second (grey) colour. The fabric 210 has a knit pattern wherein that the first plurality of fibres are at least partially separated from the second plurality of fibres, such that the front face 212 is visually different when compared to the rear surface 214—this is clearly evident in FIG. 3. This provides an architecturally more interesting fabric 210 compared to a conventional fabric having the same or similar appearance on both surfaces.

In terms of shade cloth fabric, there can be a conflict between providing an aesthetically pleasing product and a product that provides suitable performance characteristics, especially over time. For example, the combination of a lighter coloured top (or front) side 212 and a darker coloured bottom (or rear) side 214 works well, as lighter coloured shade cloths tend to suffer from dirt marks and watermark staining over time. They may initially look aesthetically pleasing, but deteriorate aesthetically more quickly than a dark coloured shade cloth. Dirt and dust settles on shade cloth during dry periods and tends to wash down and stick to the bottom of the lower fibres during wet periods. The dark colour on the bottom side will hide this dirt and dust while the lighter colour provides a more vibrant look especially when viewed from a distance.

It is to be appreciated that a structure incorporating the shade cloth fabric 210 has a distinctly differing appearance, depending on the angle from which the structure is viewed. In some such structures, the front face (perhaps in the form of a top surface) may initially be visible and, as the individual moves around the structure, they may gradually see more of a mix of colours of the two fabric surfaces until they are under the structure and see only the rear face (perhaps in the form of a bottom surface) colour. Such an arrangement may add more visual interest than conventional shade cloths manufactured from a single colour, colour combination and/or material.

The thickness of each of the fibres of the first plurality of fibres and second plurality of fibres is preferably between approximately 300 and 1,000 denier and, more preferably, approximately 477 denier. That said, the thickness of the first plurality of fibres may differ from the second plurality of fibres.

It is envisaged that the fabric 210 may be manufactured on a compound or latch needle warp knitting machine. As described previously, four guide bars of the compound or latch needle warp knitting machine may be utilised to manufacture the fabric.

The weight of the illustrated fabric 210 is preferably in the order of 350 gsm+/−20 gsm, and the cover factor is in the order of 95%+/−3%.

As stated previously the fabric 10, 110, 210 is capable of providing an architecturally more interesting product or structure than existing shade cloths, at least in part, because it has visually distinct fabric faces. It also provides a potentially more thermally comfortable fabric, with one fabric face provided to reflect solar energy, and the other face limiting most of the non-reflected light incident on the fabric from penetrating through the fabric, thereby providing a denser shade, while also limiting any build-up of heat within the fabric. Differing material properties of the two sides of the fabric 10, 110, 210 can also be utilised, including differences in other fabric aesthetics (beside colour), UV durability and weather resistance.

A reference herein to a patent document or other matter which is given as prior art is not to be taken as an admission that the document or matter was known or that the information it contains was part of the common general knowledge as at the priority date of any of the claims.

It is to be understood that various alterations, modifications and/or additions may be introduced into the construction and arrangement of the parts previously described without departing from the spirit or ambit of this invention.

The invention claimed is:

1. A knitted fabric for use as a solar shade and/or hail protection and/or wind protection cloth, comprising:

a front face and a rear face, wherein the front face includes a first plurality of fibres of at least one of a first colour, a first colour combination, a first material and a first material combination, and the rear face includes a second plurality of fibres of at least one of a second colour, a second colour combination, a second material and a second material combination, the fabric having a knit pattern wherein the knit pattern provides a visual difference between the front face compared to the rear face, and wherein the first plurality of fibres are at least partially separated from the second plurality of fibres, and wherein each fibre of the first and second plurality of fibers is generally continuous.

2. A knitted fabric according to claim 1, wherein the first plurality of fibres are at least predominantly a lighter colour or colour combination when compared to the second plurality of fibres.

3. A knitted fabric according to claim 2, wherein the first plurality of fibres are at least predominantly a light colour or colour combination, and the second plurality of fibres are predominantly a dark colour or colour combination.

4. A knitted fabric according to claim 1, wherein at least one of the first plurality of fibres and second plurality of fibres are at least substantially manufactured from one or more of nylon, polypropylene, polyester, ultra-high molecular weight high density polyethylene (UHMWHDPE), high-density polyethylene (HDPE), polytetrafluoroethylene (PTFE), carbon fibre, fibreglass and metal.

5. A knitted fabric according to claim 4, wherein the first plurality of fibres and second plurality of fibres are manufactured from Polyethylene.

6. A knitted fabric according to claim 1, wherein the fabric is a warp knitted fabric.

7. A knitted fabric according to claim 1, wherein the thickness of each of the fibres of the first plurality of fibres and second plurality of fibres is between approximately 300 and 1,000 denier.

8. A knitted fabric according to claim 7, wherein the thickness of each of the fibres of the first plurality of fibres and second plurality of fibres is approximately 477 denier.

9. A knitted fabric according to claim 1, wherein each of the first and second plurality of fibres is manufactured from at least one of a monofilament, multi-filament and tape.

10. A knitted fabric according to claim 1, wherein the fabric is manufactured on a compound or latch needle warp knitting machine.

11. A knitted fabric according to claim 10, wherein four guide bars of the compound or latch needle warp knitting machine are utilised to manufacture the fabric.

12. A knitted fabric according to claim 11, wherein the four guide bars include a front guide bar, a second guide bar, a third guide bar and a fourth guide bar that follow the following knitting movements to manufacture the fabric:

front guide bar: 1-0/0-1//;
second guide bar: 1-0/3-4//;
third guide bar: 0-0/3-3//; and
fourth guide bar: 3-3/0-0//.

13. A knitted fabric according to claim 11, wherein the four guide bars include a front guide bar, a second guide bar, a third guide bar and a fourth guide bar that follow the following knitting movements to manufacture the fabric:

front guide bar: 1-0/0-1//;
second guide bar: 1-0/3-4//;
third guide bar: 0-0/1-1//; and
fourth guide bar: 4-4/0-0//.

14. A knitted fabric according to claim 12, wherein, in use, the front guide bar supplies yarn for a chain of knitted loops, the second guide bar supplies weft yarn, the third guide bar supplies intertwined yarn or a laid-in yarn, and the fourth guide bar supplies a laid-in yarn.

15. A knitted fabric according to claim 14, wherein the front guide bar supplies monofilament yarn, the second guide bar supplies monofilament yarn, the third guide bar supplies monofilament yarn and the fourth guide bar supplies tape yarn.

16. A knitted fabric according to claim 1, wherein the fabric weight is 350 gsm+/−20 gsm.

17. A knitted fabric according to claim 1, wherein the fabric has a cover factor of 95% +/−3%.

18. A knitted fabric according to claim 1, wherein the fabric is one or more of a solar shade, hail and wind cloth protection fabric.

19. A knitted fabric according to claim 1, wherein the fabric is one or more of a geotextile, building façade, privacy screen, advertising banner or screen.

* * * * *